US006378749B1

(12) United States Patent
Robin

(10) Patent No.: US 6,378,749 B1
(45) Date of Patent: Apr. 30, 2002

(54) BEARING UNIT FOR MATERIAL-WEB NIP PULLEYS

(75) Inventor: Philippe Robin, Cires les Mello (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/645,764

(22) Filed: Aug. 25, 2000

(30) Foreign Application Priority Data

Aug. 25, 1999 (DE) ..... 199 40 398
Apr. 14, 2000 (FR) ..... 00 04836

(51) Int. Cl.[7] ..... G03B 1/56; B65H 20/00
(52) U.S. Cl. ..... 226/90; 226/155; 226/177
(58) Field of Search ..... 226/176, 177, 226/154, 155, 90

(56) References Cited

U.S. PATENT DOCUMENTS 2,815,626 A * 12/1957 Fahrenbach ..... 226/154 X
3,770,176 A * 11/1973 Hanzawa et al. ..... 226/176
3,877,627 A * 4/1975 Boase et al. ..... 226/154 X
4,048,831 A * 9/1977 Fabian et al. ..... 226/177 X
4,060,187 A * 11/1977 Grob ..... 226/177 X
4,119,256 A * 10/1978 Vogtmann et al. ..... 226/177
5,738,264 A 4/1998 Jackson et al.
5,967,512 A * 10/1999 Irsik ..... 226/177 X

FOREIGN PATENT DOCUMENTS

DE 31 39 118 C2 6/1985
DE 84 24 420.8 7/1986
EP 0 614 838 A1 9/1994

* cited by examiner

*Primary Examiner*—Michael R. Mansen
(74) *Attorney, Agent, or Firm*—Herbert L. Lerner; Laurence A. Greenberg; Werner H. Stemer

(57) ABSTRACT

A bearing unit for throwing a movable nip pulley on and off a stationary mounted nip pulley has an actuating device for throwing the movable nip pulley laterally onto a material web, and adjustable stops for adjusting an actuating travel of the movable nip pulley. The bearing unit includes a bearing plate whereon one of the adjustable stops is accommodated, and a bearing foot having an anchorage. The bearing plate is movable around the anchorage of the bearing foot so as to be adjusted coaxially with respect to the anchorage. The bearing plate also includes a prestressing element accommodated on the bearing plate, a bearing housing subjectible to a loading by the prestressing element, and a damping element actable upon the prestressing element. A folder including the bearing unit is disclosed.

10 Claims, 4 Drawing Sheets

Fig.4.1
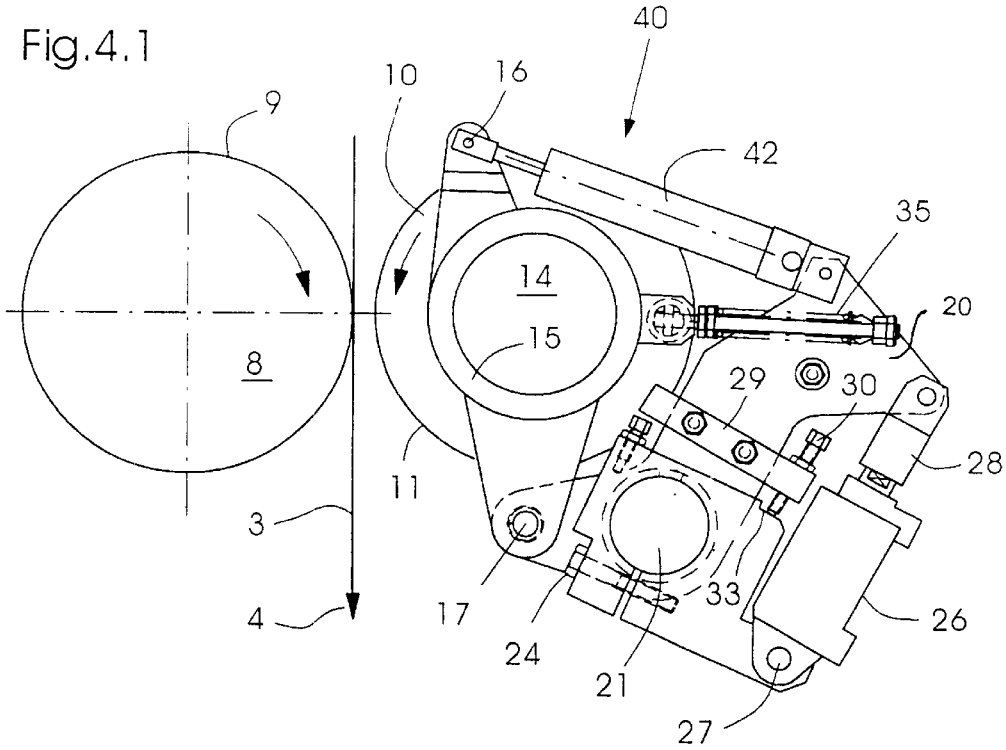
Fig.4.2
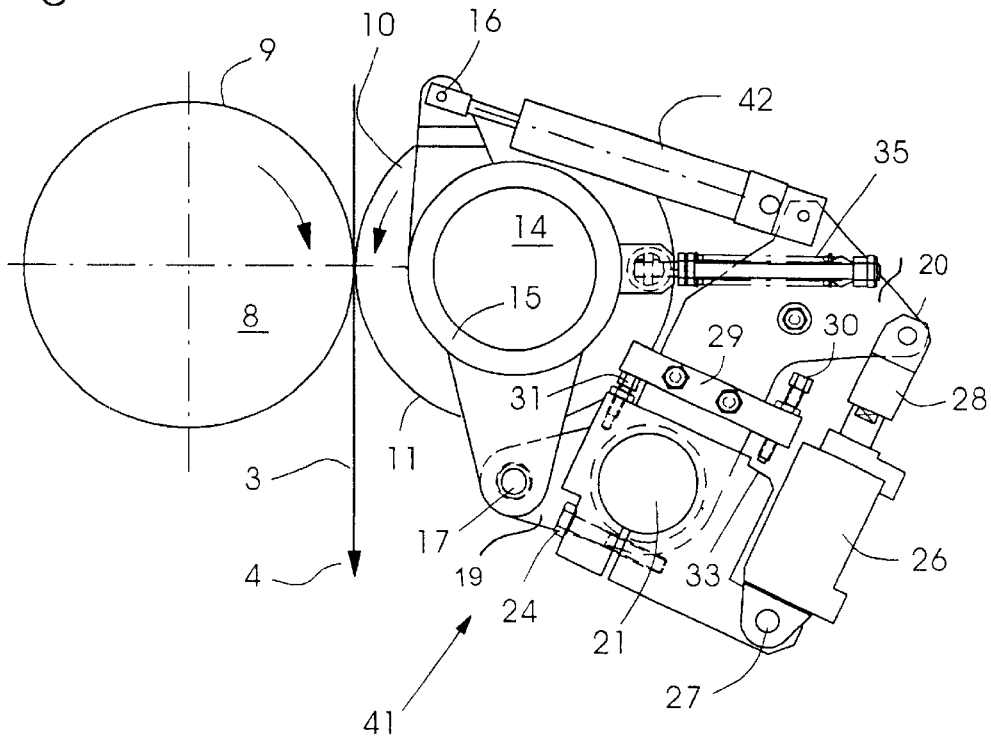

BEARING UNIT FOR MATERIAL-WEB NIP PULLEYS

BACKGROUND OF THE INVENTION

FIELD OF THE INVENTION

The invention relates to a bearing unit for material-web nip pulleys or pull rollers and, more particularly, for such nip pulleys or pull rollers which hold a material web under tension along the web path thereof and convey the material web through a folder, for example.

U.S. Pat. No. 5,738,620 is concerned with the mounting of pre-folding and pinch rollers in a folder. The diameters of the rollers are identical, and respective pairs of the rollers are arranged after one another, as viewed in the folding direction. The roller arrangement is rotatably accommodated between two side walls. One of the pre-folding rollers and one of the pinch rollers, respectively, are held stationary in position but can rotate at the two ends thereof in the side walls. The first pre-folding roller is rotatably mounted or journalled at the ends thereof, the bearings therefor being arranged on arms accommodated on the side walls. Connecting arms, whereon the second pinch roller is mounted, are likewise accommodated on the bearings of the first pre-folding roller. The connecting arms are spring-loaded perpendicularly with respect to the folding direction and are set against stops. The stops are accommodated in the side walls in a manner that the two pre-folding rollers and the two pinch rollers do not touch one another. Consequently, the corresponding bearings are relieved of any load. The folded copies emerging from the pre-folding rollers lift the connecting arms off the stops thereof and, by this movement, produce a gap having a width that depends upon the thickness of the folded copy. The gripping of the copy is thereby facilitated.

U.S. Pat. No. 5,738,264 discloses a device by which nip pulleys or pull rollers in the folder are automatically adjustable. Mutually opposing nip pulleys, one of which is stationary and the other is positionable relative to the latter, define an adjustable gap or nip between the respective peripheries thereof. The gap can be adjusted by a setscrew that is derivable by a servomotor. The revolutions of the setscrew are measured by a potentiometer assigned to the latter. Through the intermediary of a stop on the setscrew, the travel of the screw is limited. The rollers are thrown against one another, i.e., brought into mutual engagement, by a spring, but the spring also permits the movable nip pulley or pull roller for the material web to be thrown off or disengaged in the event of an overload. Through the intermediary of a sensor, the relative movements of the travel screw and stop to one another can be detected, signals from the sensor being used by a programmable control system to control the servomotor.

In the device disclosed in U.S. Pat. No. 5,738,264, an input provided by the operator is necessary in order then to produce automatically a match, which is triggered by the response of the sensor, of the gap widths between the surfaces of the pull rollers or nip pulleys.

SUMMARY OF THE INVENTION

It is accordingly an object of the invention to provide a A bearing unit for material-web nip pulleys or pull rollers which is a further development of the prior art and wherein an adjustment relative to one another of the pull rollers or nip pulleys which grip the material webs is effected independently of any intervention by the operator.

With the foregoing and other objects in view, there is provided, in accordance with one aspect of the invention, a bearing unit for throwing a movable nip pulley on and off a stationarily mounted nip pulley, having an actuating device for throwing the movable nip pulley laterally onto a material web, and having adjustable stops for adjusting actuating travel of the movable nip pulley, comprising a bearing plate whereon one of the adjustable stops is accommodated, a bearing foot having an anchorage, the bearing plate being movable around the anchorage of the bearing foot so as to be adjusted coaxially with respect to the anchorage, a prestressing element accommodated on the bearing plat, a bearing housing subjectible to a loading by the prestressing element, and a damping element actable upon the prestressing element.

In accordance with another feature of the invention, the actuating travel of the movable nip pulley is predefinable by the adjustable stops for determining relative movement between the bearing plate and the bearing foot.

In accordance with a further feature of the invention, the bearing plate is movable around the anchorage relative to the bearing foot.

In accordance with an added feature of the invention, the actuating device is disposed between the bearing plate and the bearing foot.

In accordance with an additional feature of the invention, the actuating device is activatable for pivoting the bearing housing about an articulation point on the bearing plate.

In accordance with yet another feature of the invention, the damping element is accommodated on the bearing plate, and the bearing housing is permanently subjected to a loading by the damping element.

In accordance with yet a further feature of the invention, the prestressing element is a spring accommodated between the bearing housing and the bearing plate.

In accordance with yet an added feature of the invention, the adjustable stops are used for varying prestressing force at the prestressing element.

In accordance with yet an additional feature of the invention, the damping element is a double-acting damping element.

In accordance with a concomitant aspect of the invention, there is provided a folder for processing material webs, having a bearing unit for throwing a movable nip pulley on and off a stationarily mounted nip pulley, including an actuating device for throwing the movable nip pulley laterally onto a material web, and adjustable stops for adjusting actuating travel of the movable nip pulley, the bearing unit comprising a bearing plate whereon one of the adjustable stops is accommodated, a bearing foot having an anchorage, the bearing plate being movable around the anchorage of the bearing foot so as to be adjusted coaxially with respect to the anchorage, a prestressing element accommodated on the bearing plat, a bearing housing subjectible to a loading by the prestressing element, and a damping element actable upon the prestressing element. prestressing element accommodated on the bearing plate, and a damping element actable upon the prestressing element.

The advantages inherent in the construction according to the invention are many and various.

Due to the permanent loading of the bearing housing, both with an adjusting force by a prestressing element and by the connection to a damping element, in the event of deflections, which, for example, may be caused by the passage of a relatively thick web splice, the movable roller is set back into the initial position thereof again, without requiring any intervention by the pressman; due to the nip-pulley or pull-roller configuration according to the invention, a lower sensitivity of the pair of nip pulleys or pull rollers is achieved, even during the passage of disruptive or faulty locations in the nip-pulley or pull-roller gap. With the mounting of the movable pull rollers or nip pulleys according to the invention, the web tension may be kept constant better, which is beneficial to the maintenance of the cutting register.

Furthermore, with the construction according to the invention, there is no longer any need for the pressman to perform a fine adjustment manually if the grammage of the web or the page combination pattern should change.

In an advantageous development of the idea upon which the invention is based, the movement of throwing the movable pull roller or nip pulley onto the material web can be achieved by a relative movement between a bearing foot and a bearing plate that is mounted coaxially with respect to the latter, it being possible for the relative movement to be predefined by adjustable stops. By an actuating device disposed between the bearing plate and the bearing foot, the adjusting movement may be impressed upon the bearing housings that accommodate the pull rollers or nip pulleys.

By connecting the bearing housing to a damping element that acts in both directions, i.e., is double-acting, it is additionally possible to prevent the build-up of oscillations at the bearing housing about the respective articulation point thereof on the lower extension of the bearing plate, so that when faults or splices in the material web pass through, the constant web tension can be maintained, and a build-up of oscillations of the movable pull rollers or nip pulleys resulting from the faults or splices, does not occur. Fluctuations in the web tension are mostly associated with fluctuations in the cutting accuracy of the material webs at the pair of cutting cylinders. This is followed by fluctuations in the quality of the copies to be separated from the material web, so that the maintenance of a constant web tension, even during the passage of faults or splices, continues to be assured, which is essential for the maintenance of a high product quality in the folder.

The engagement or throwing force of the movable pull roller or nip pulley onto the material web may be adjusted by a prestressing element, for example, in the form of a helical spring, so that the respectively optimum adjusting force can be set in accordance with the web thickness in the case of single-ply or multi-ply web runs.

The bearing unit according to the invention may advantageously be used for throwing-on and throwing-off, i.e., engagement and disengagement, movements, respectively, of a movable pull roller or nip pulley in conventional folders and also in pinless folders. In both types of folders, ensuring a constant web tension is critical for a high product quality with high accuracy of cutting register.

Other features which are considered as characteristic for the invention are set forth in the appended claims.

Although the invention is illustrated and described herein as embodied in a bearing unit for material-web nip pulleys or pull rollers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIGS. 4.1 and 4.2 are reduced views of FIG. 3, showing the bearing unit accommodating the movable pull roller or nipping pulley in different operating phases thereof, namely wherein the pull roller or nip pulley is in a thrown-off or disengaged position thereof, and in a thrown-on or engaged position thereof, respectively.

DESCRIPTION OF THE PREFERRED EMBODIMENTS

Figure 1:
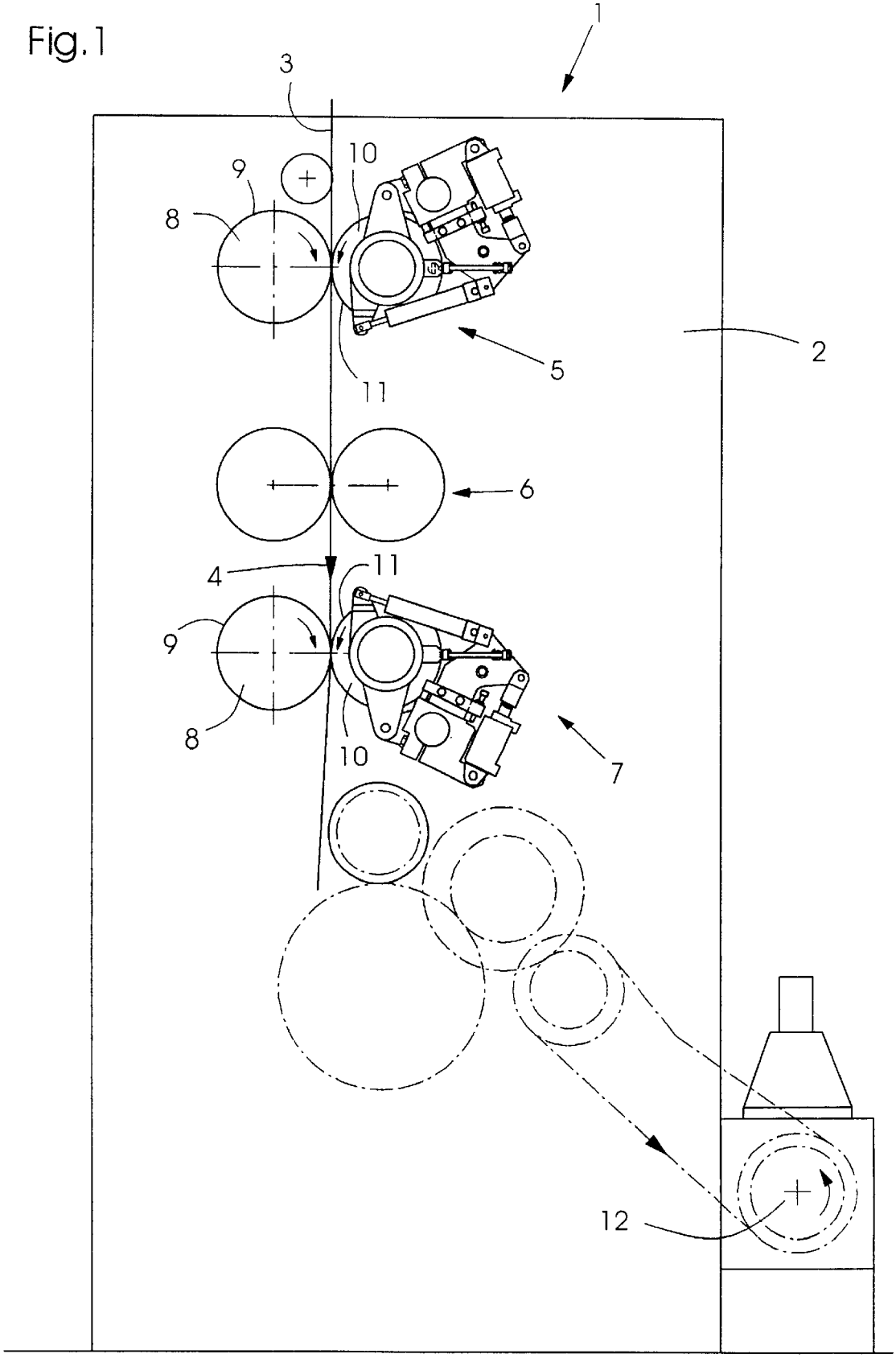
FIG. 1 is a diagrammatic side elevational view of an inlet region of a folder cylinder part having two pairs of nip pulleys or pull rollers located behind one another, as viewed in web travel direction.

Referring now to the drawings and, first, particularly to FIG. 1 thereof, there is shown therein a side wall 2 of a folder 1, into which a material web 3 has run in a web traveling direction represented by the arrowhead 4. The material web 3 passes through a first pair 5 of nip pulleys or pull rollers including a pull roller or nip pulley 8 that is stationarily mounted and a pull roller or nip pulley 10 that is movable. The material web 3 then passes through a gap or nip formed between the two peripheries 9 and 11, respectively, of the pull rollers or nip pulleys 8 and 10, and because the pairs 5 and 7 of pull rollers or nip pulleys, respectively, are driven, is therefore conveyed into the otherwise non-illustrated cylinder part of the folder 1.

After passing through the upper, first pair 5 of pull rollers or nip pulleys, the material web 3, which may be single-ply or multi-ply, passes through a pair 6 of perforating rollers, whereat the material web 3 can be perforated either along the folded back thereof at a first cross-fold or else transversely with respect to the web travel direction 4, depending upon the application.

The material web 3 then passes into a further, lower pair 7 of pull rollers or nip pulleys, which have a construction similar to that of the first-mentioned pair S of pull rollers or nip pulleys. The difference resides only in that the movable pull roller or nip pulley 10 in the first pull-roller or nip-pulley pair 5 is articulated at the top of the bearing unit, whereas in the lower pull-roller or nip-pulley pair 7, it is articulated at the bottom of the bearing unit.

Figure 2:
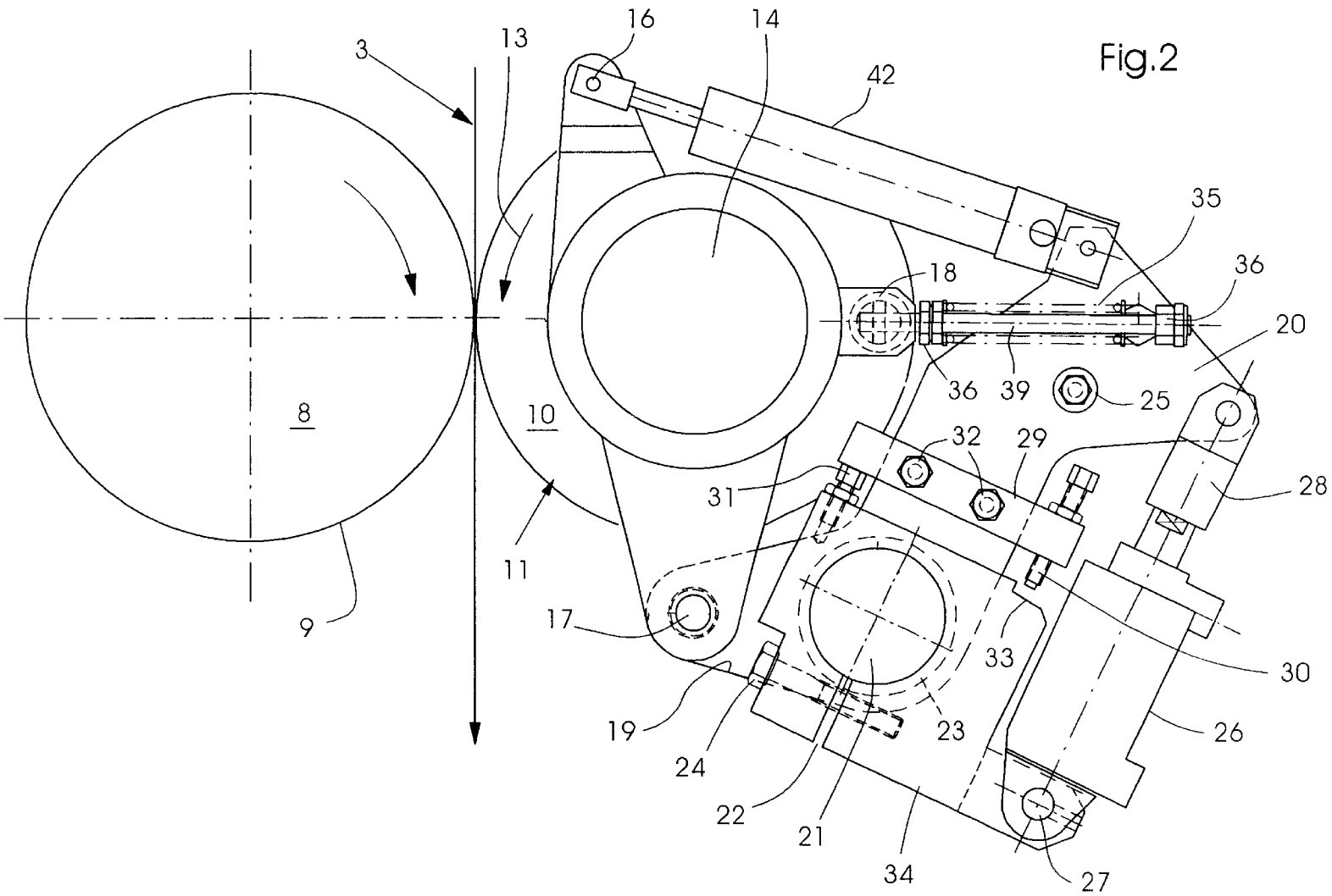
FIG. 2 is an enlarged fragmentary view of FIG. 1, showing a bearing unit for a movable nip pulley or pull roller.

In the enlarged fragmentary view of FIG. 2, a bearing unit according to the invention for throwing the movable pull roller or nip pulley on and off, i.e., for engaging or disengaging it, is shown in greater detail. The two pull rollers or nip pulleys 8 and 10, which rotate in the web travel direction 4 and in the direction of rotation represented by the arrow 13, convey a material web 3 downwardly. The movable pull roller or nip pulley 10 is accommodated by respective roller journals 14 thereof in an eye formed in a bearing housing 15. For its part, the bearing housing 15 is pivotably mounted by a lower articulation point 17 thereof on an extension 19 of a bearing plate 20. At the side of the bearing housing 15 opposite to the lower articulation point 17, a damping element 42 is articulatedly connected to the bearing housing 15 at an upper articulation point 16 and, for its part, is supported on the bearing plate 20 of the bearing unit. In addition, an articulating point 18 for a prestressing element 35 is formed on the bearing housing 15.

A foot 34 of the bearing unit is fixed to an anchorage 21, which can be constructed for example as a shaft extending from one of the side walls 2 to another of the side walls 2 of the folder 1. With the aid of a clamping screw 24 that passes through a slot 22 formed in the bearing foot 34, the latter is clamped and held so that it cannot rotate at the anchorage 21 which, as noted hereinbefore, is preferably constructed as a shaft. On the bearing foot 34, which is mounted on the shaft 21 so as to be stationary, there is a stop 31 which, in the illustrated exemplary embodiment, is screwed entirely into a threaded bore formed in the bearing foot 34. In addition, in an upper region of the bearing foot 34, as viewed in FIG. 2, a stop face 33 is formed which is assigned to a stop 31 accommodated on the bearing plate 20. Also articulated on the bearing foot 34, at the articulation point 27, is an actuating element 26 having an actuating rod 28 connected to the bearing plate 20 which is movable relative to the bearing foot 34.

The movable bearing plate 20 is likewise accommodated on the shaft 21, however, it is pivotable about the shaft 21, in contrast with the bearing foot 34. A beam 29 is affixed to the bearing plate 20, besides the actuating elements 26 for engaging and disengaging or throwing the movable pull roller 10 on and off, respectively. The beam 29, on the one hand, serves for accommodating the adjustable stop 30, and on the other hand, with an end thereof directed towards the movable roller 10, serves as a stop for the aforementioned stop element 31 accommodated in the bearing foot 34. The beam 29 is connected to the bearing plate 20 by bolts 32. Fixed in the upper region of the bearing plate 20, as viewed in FIG. 2., is a stud 25, with which the parallelism of the bearing plates 20 located opposite one another on the side walls 2 of the folder 1 can be monitored.

In addition, a damping element 42 that is active in both directions, namely the thrown-on or engagement and the thrown-off or disengagement direction, respectively, is mounted on the upper part of the bearing plate 20; also provided thereon is a prestressing element 35 formed as a compression spring accommodated between two adjustable stops 36. The spring 35 is guided on a rod 39 that passes therethrough. Through the intermediary of the stops 36, the spring force can be reduced by moving the stops 36 apart, and an increase in the spring force can be achieved by adjusting the stops 36 towards one another.

Figure 3:
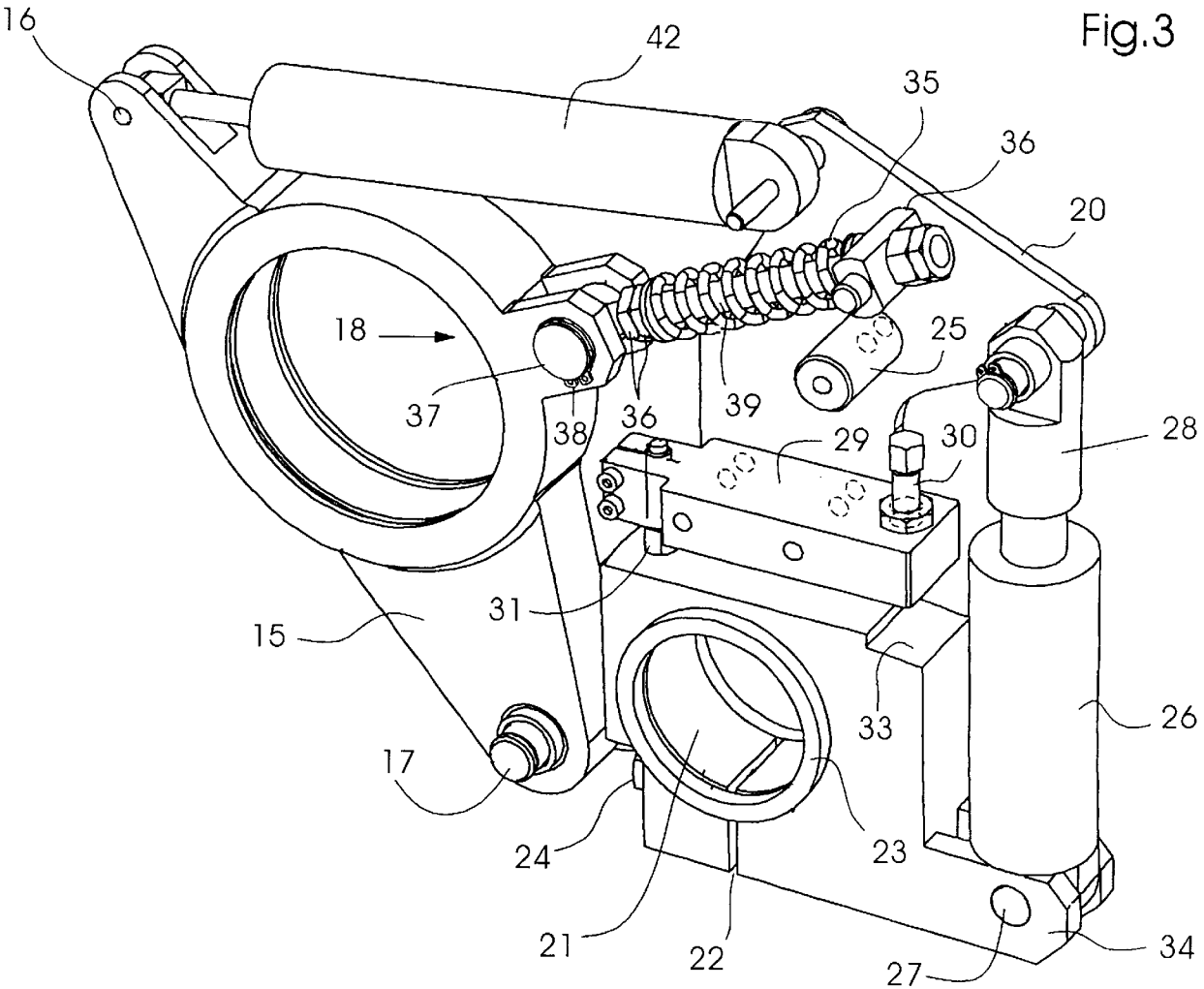
FIG. 3 is a perspective view of the bearing unit according to FIG. 2.

From the perspective view according to FIG. 3, it is apparent that the rod 39 is accommodated by the pin 37 on the bearing housing 15, and secured thereon by a Seeger ring or circlip 38. Underneath the prestressing element 35, the stud 25 is accommodated on the bearing plate 20; arranged beneath the prestressing element 35 is the beam 29, whereon the two stops 30 and 31, which limit the adjustment travel of the bearing plate 20 relative to the bearing foot 34, are accommodated.

FIGS. 4.1 and 4.2 show the movable pull roller or nip pulley 10 in the two adjustment positions 40 and 41 thereof, respectively.

In FIG. 4.1, the piston rod 28, which is connected to the upper end of the bearing plate 20, is retracted into the adjusting element 26. Thereby, the bearing plate 20 together with the bearing housing 15 accommodated at the articulation point 17 is tilted slightly about the shaft 21, so that the spacing illustrated between the periphery 11 of the movable pull roller or nip pulley 10 and the material web 3 results. The throw-off or disengagement travel is limited here by the adjustable stop 30 which, in the position 40, rests on or engages the stop face 33 formed on the bearing foot 34. An adjustment of the stop 30 upwardly, as viewed in FIG. 4.1, for example, would result in the rotation of the roller periphery 11 farther away from the web 3.

FIG. 4.2 shows the movable pull roller or nip pulley 10 in the thrown-on or engaged position 41 thereof with respect to the material web 3.

In the thrown-on or engaged position 41, the actuating rod 28 is extended out of the actuating element 26. The bearing plate 20 is thereby pivoted about the shaft 21, until the beam 29 almost touches the head of the stop element 31. Contact of the roller periphery 11 with the material web 3 is then produced by the prestressing element 35 which forces the bearing housing 15 about the articulation point 17 thereof against the material web 3 on the stationary pull roller or nip pulley 8. The damping element 42 articulatedly connected at 16 to the bearing housing 15 at the top, as shown in FIG. 4.2, prevents any oscillation build-up at the pivotably mounted pull roller or nip pulley 10 about the articulation point 17 thereof on the extension 19 of the bearing plate 20 during the passage of disruptive or trouble spots, such as pasted or spliced locations of the web.

Consequently, when the movable pull roller or nip pulley 10 is thrown on or engaged in the position 41 according to FIG. 4.2, the engageable pull roller or nip pulley 10 is prevented from lifting off the material web 3, even if only briefly, so that no fluctuations in web tension can occur. The bearing unit according to the aforedescribed invention can therefore be used advantageously both in conventional folders and in pinless folders, and both in newspaper printing and in job or commercial printing.

I claim:

1. A bearing unit for throwing a movable nip pulley on and off a stationarily mounted nip pulley, having an actuating device for throwing the movable nip pulley laterally onto a material web, and having adjustable stops for adjusting actuating travel of the movable nip pulley, comprising a bearing plate whereon one of the adjustable stops is accommodated, a bearing foot having an anchorage, said bearing plate being movable around said anchorage of said bearing foot so as to be adjusted coaxially with respect to said anchorage, a prestressing element accommodated on said bearing plate, a bearing housing subjectible to a loading by said prestressing element, and a damping element actable upon said prestressing element.

2. The bearing unit according to claim 1, wherein the actuating travel of the movable nip pulley is predefinable by said adjustable stops for determining relative movement between said bearing plate and said bearing foot.

3. The bearing unit according to claim 1, wherein said bearing plate is movable around said anchorage relative to said bearing foot.

4. The bearing unit according to claim 3, wherein the actuating device is disposed between said bearing plate and said bearing foot.

5. The bearing unit according to claim 1, wherein the actuating device is activatable for pivoting said bearing housing about an articulation point on said bearing plate.

6. The bearing unit according to claim 1, wherein said damping element is accommodated on said bearing plate, and said bearing housing is permanently subjected to a loading by said damping element.

7. The bearing unit according to claim 1, wherein said prestressing element is a spring accommodated between said bearing housing and said bearing plate.

8. The bearing unit according to claim 1, wherein said adjustable stops are used for varying a prestressing force at said prestressing element.

9. The bearing unit according to claim 1, wherein said damping element is a double-acting damping element.

10. A folder for processing material webs, having a bearing unit for throwing a movable nip pulley on and off a stationarily mounted nip pulley, including an actuating device for throwing the movable nip pulley laterally onto a material web, and adjustable stops for adjusting actuating travel of the movable nip pulley, the bearing unit comprising a bearing plate whereon one of the adjustable stops is accommodated, a bearing foot having an anchorage, said bearing plate being movable around said anchorage of said bearing foot so as to be adjusted coaxially with respect to said anchorage, a prestressing element accommodated on said bearing plat, a bearing housing subjectible to a loading by said prestressing element, and a damping element actable upon said prestressing element.

* * * * *